US007357349B1

(12) United States Patent
Huang

(10) Patent No.: US 7,357,349 B1
(45) Date of Patent: Apr. 15, 2008

(54) STRETCH FILM DISPENSER WITH AUXILIARY STAND DEVICE

(75) Inventor: Harrison Huang, No. 23, Lint T'So Rd., Sheng Kang Hsian, Taichung Hsien (TW)

(73) Assignee: Harrison Huang (TW)

( * ) Notice: Subject to any disclaimer, the term of this patent is extended or adjusted under 35 U.S.C. 154(b) by 0 days.

(21) Appl. No.: 11/776,809

(22) Filed: Jul. 12, 2007

(51) Int. Cl.
*B65H 75/18* (2006.01)

(52) U.S. Cl. ..... 242/588; 242/405.3

(58) Field of Classification Search ..... 242/588, 242/588.1, 588.2, 591, 405, 405.3
See application file for complete search history.

(56) References Cited

U.S. PATENT DOCUMENTS 4,102,513 A * 7/1978 Guard ..... 242/588
4,166,589 A * 9/1979 Hoover et al. ..... 242/588
4,535,951 A * 8/1985 Riemenschneider, III ... 242/588
4,630,786 A * 12/1986 Lambert et al. ..... 242/588
4,714,211 A * 12/1987 Hwang ..... 242/588
5,094,395 A * 3/1992 Lambert ..... 242/588.2
6,126,108 A * 10/2000 Bush ..... 242/588.2
6,883,298 B2 * 4/2005 Gooding et al. ..... 242/588.2

FOREIGN PATENT DOCUMENTS

GB 2 121 001 * 12/1983

* cited by examiner

*Primary Examiner*—William A Rivera
(74) *Attorney, Agent, or Firm*—Browdy and Neimark

(57) ABSTRACT

A stretch film dispenser of the present invention is equipped with an auxiliary stand device. The stretch film dispenser includes a base, a curved handle bar, which has a handle on a distal end thereof, fixed to a circumference of the base, and a shaft, which has a handle on a distal end thereof, fixed to a top of the base to mount a stretch film roll thereon. The auxiliary stand device is fixed to the handle bar. A bottom side of the auxiliary stand device is substantially even with a bottom side of the base, and a width of the auxiliary stand device is greater than a diameter of the handle bar therefore a bottom size of the stretch film dispenser increases to prevent the stretch film dispenser from tipping over.

7 Claims, 5 Drawing Sheets

STRETCH FILM DISPENSER WITH AUXILIARY STAND DEVICE

BACKGROUND OF THE INVENTION

1. Field of the Invention

The present invention relates generally to a stretch film dispenser, and more particularly to a stretch film dispenser with an auxiliary stand device.

2. Description of the Related Art

FIG. 1 shows a conventional stretch film dispenser 90, which includes a base 91 with a protrusion 97 on a circumference thereof. A curved handle bar 92 is fixed to the protrusion 97 of the base 91, and a handle 93 is fixed to a distal end of the handle bar 92. A shaft 94 is fixed to a top of the base 91 to mount a stretch film roll 96 thereon, and a handle 95 is fixed to a distal end of the shaft 94. User may hold the handles 93 and 95 to operate the stretch film dispenser 90. To put the stretch film dispenser 90 on the ground, the base is a desired element touching the ground. The stretch film dispenser 90 usually tips over because the base 91 is small and the stretch film roll 96 is very heavy and its position is high.

SUMMARY OF THE INVENTION

The primary objective of the present invention is to provide a stretch film dispenser, which is equipped with an auxiliary stand device to stable the stretch film dispenser when it is put on the ground.

According to the objective of the present invention, a stretch film dispenser is equipped with an auxiliary stand device. The stretch film dispenser includes a base, a curved handle bar, which has a handle on a distal end thereof, fixed to a circumference of the base, and a shaft, which has a handle on a distal end thereof, fixed to a top of the base to mount a stretch film roll thereon. The auxiliary stand device is fixed to the handle bar. A bottom side of the auxiliary stand device is substantially even with a bottom side of the base, and a width of the auxiliary stand device is greater than a diameter of the handle bar therefore a bottom size of the stretch film dispenser increases to prevent the stretch film dispenser from tipping over.

DETAILED DESCRIPTION OF THE INVENTION

Figure 3:
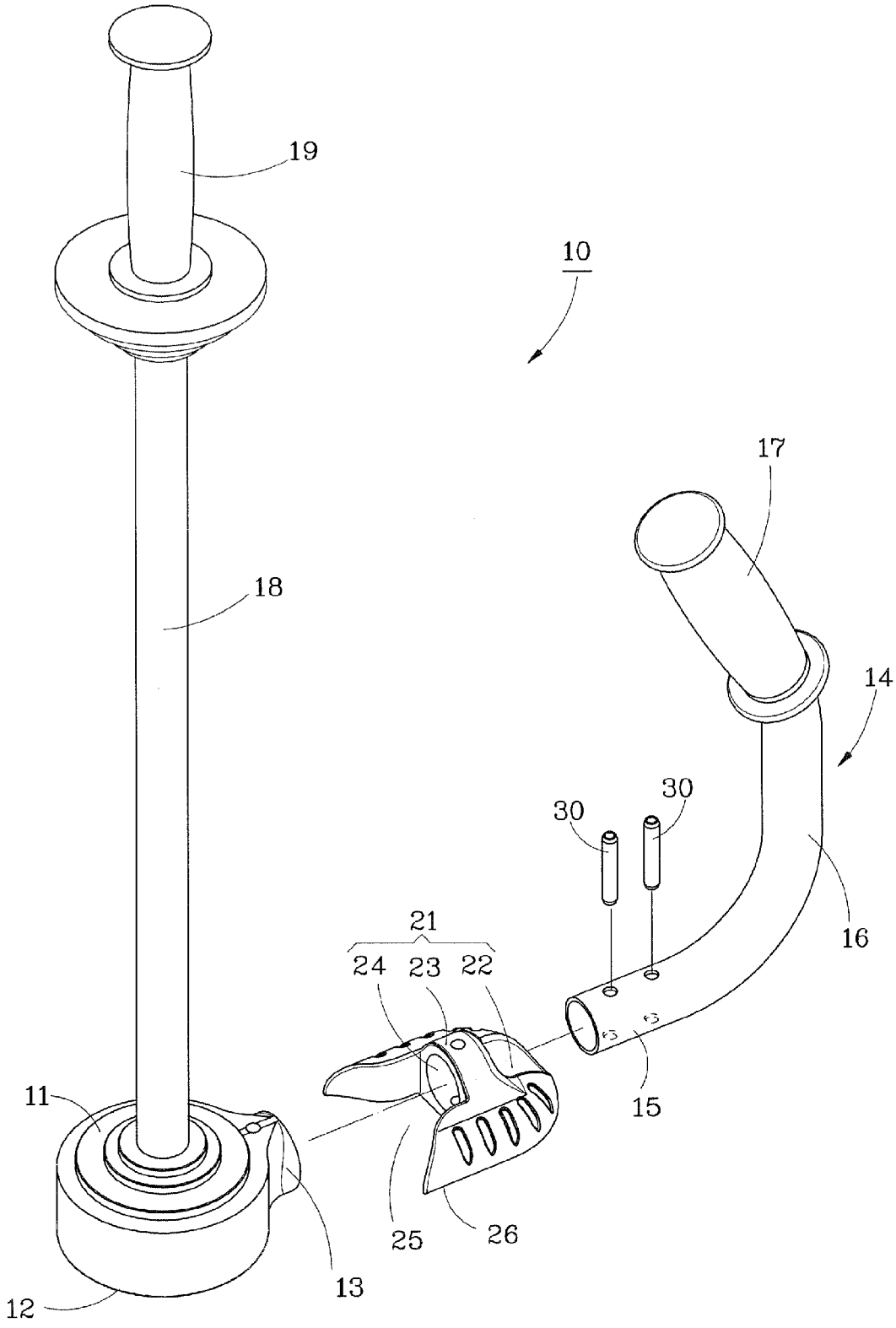
FIG. 3 is an exploded view of the preferred embodiment of the present invention.

As shown in FIG. 12 and FIG. 3, a stretch film dispenser 10 of the preferred embodiment of the present invention is equipped with an auxiliary stand device 20. The stretch film dispenser 10 includes a base 11 having a bottom side 12 and a protrusion 13 with a bore at a circumference thereof. A handle bar 14 is inserted into the bore of the protrusion 13 and fixed therein by a pin 30. The handle bar 14 has a straight section 15 connected to the protrusion 13 of the base 11 and a curved section 16 with a handle 17 on a distal end thereof. An upright shaft 18 is fixed to a top of the base to mount a stretch film (not shown) thereon, and a handle 19 is fixed to a distal end of the shaft 18. The stretch film dispenser 10 is as same as the conventional stretch film dispenser 90 as described in the background.

Figure 1:
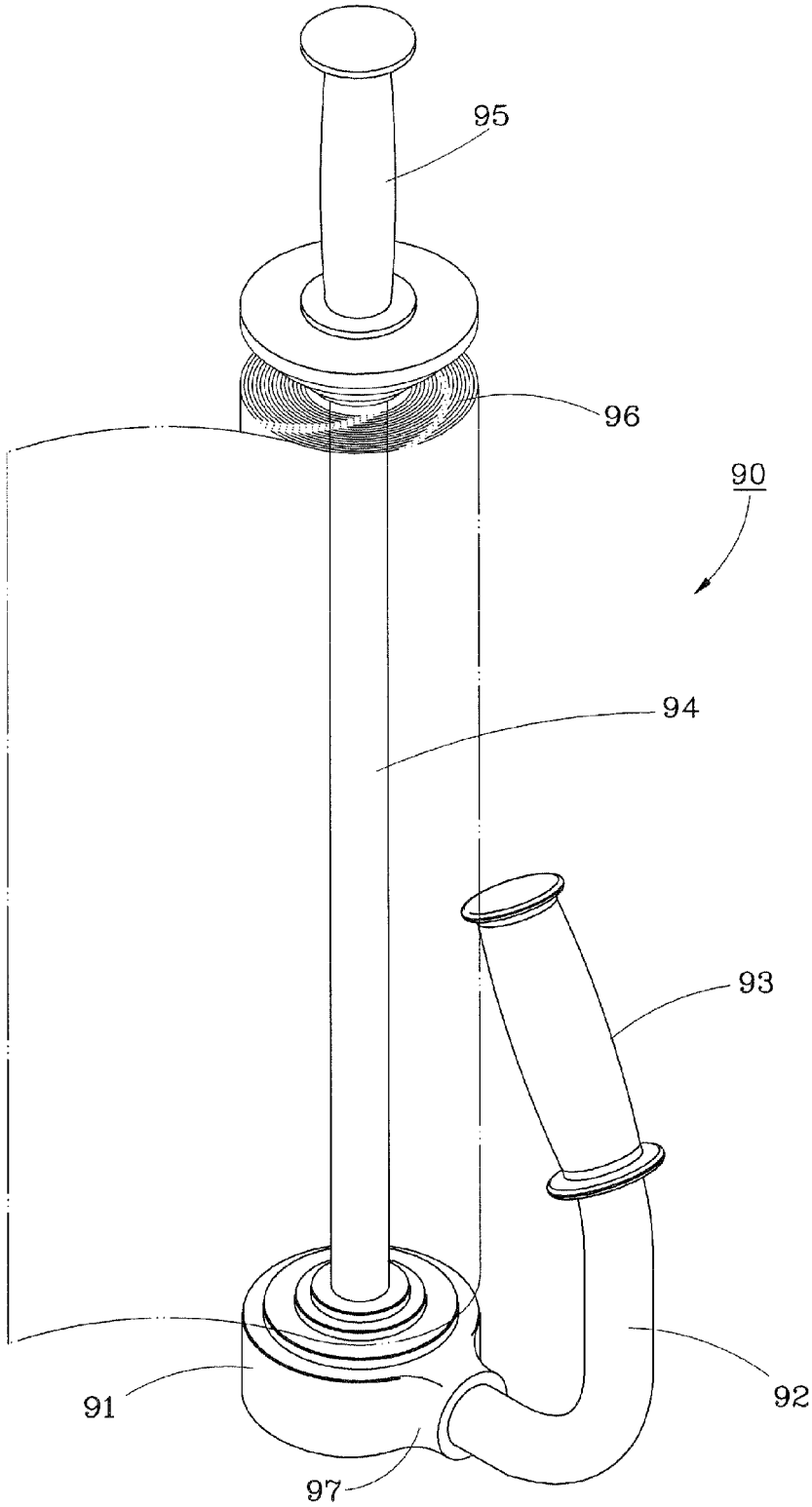
FIG. 1 PRIOR ART
FIG. 1 is a perspective view of the conventional stretch film dispenser.
Figure 2:
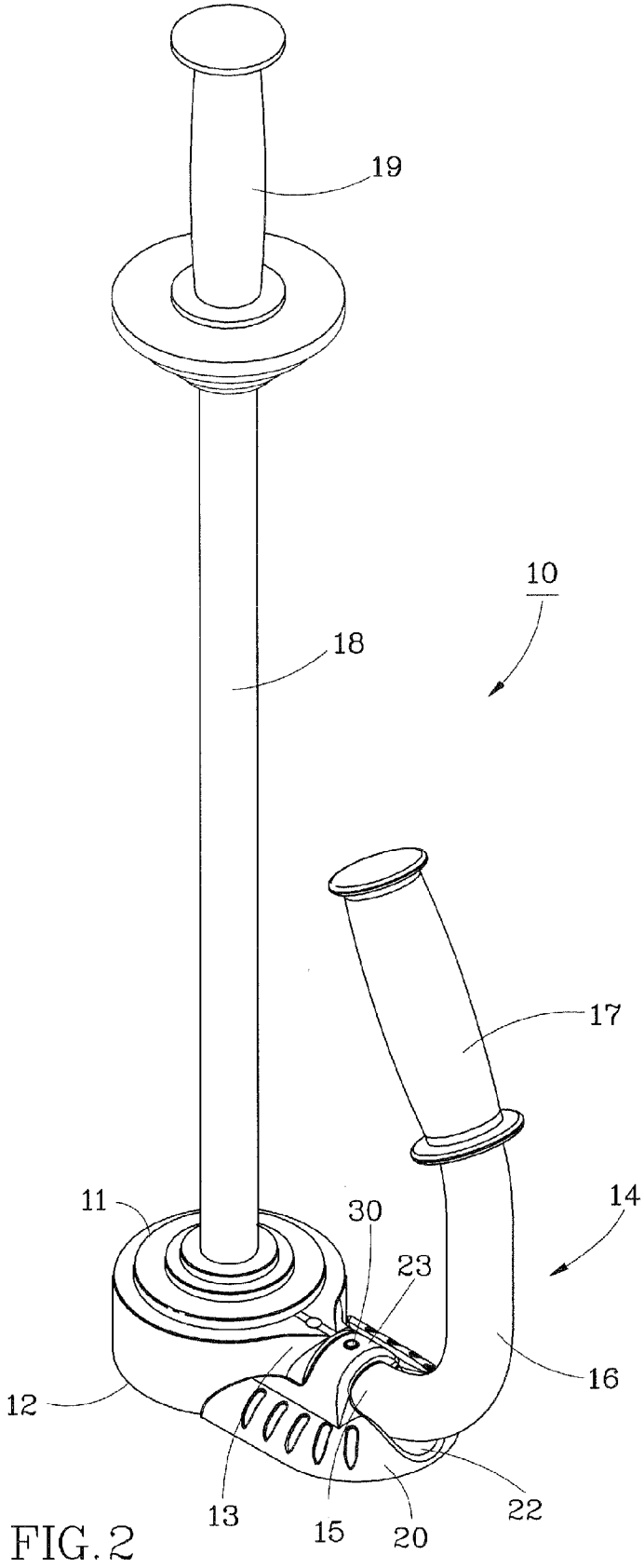
FIG. 2 is a perspective view of a preferred embodiment of the present invention in operation.
Figure 4:
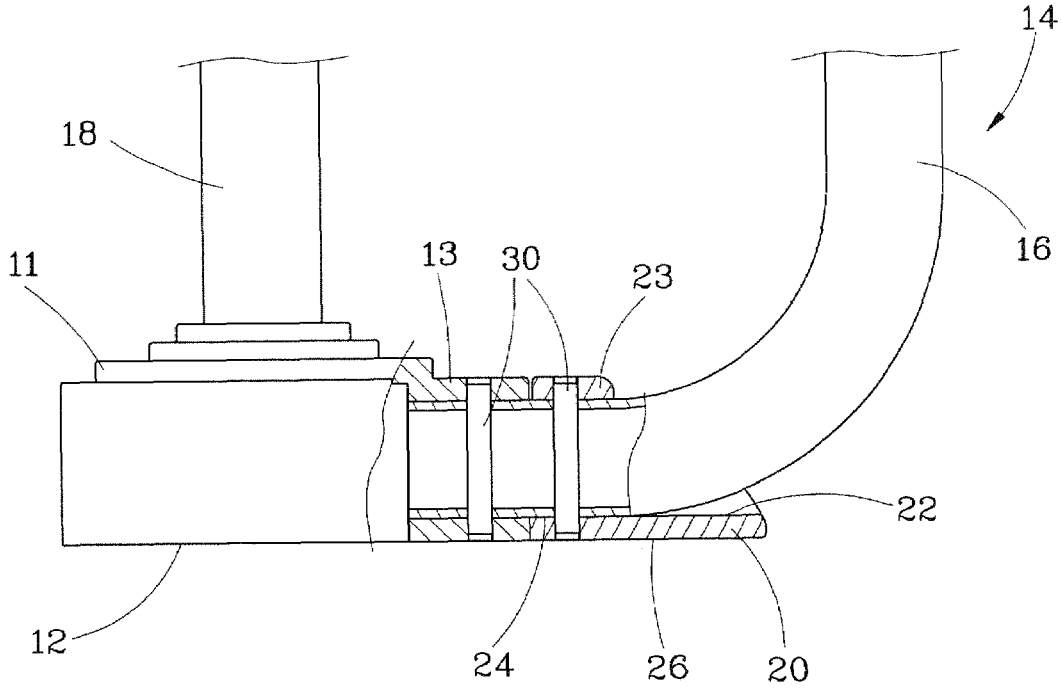
FIG. 4 is a sectional view of the preferred embodiment of the present invention.

The auxiliary stand device 20 including a connecting portion 21, referring to FIG. 2 to FIG. 4, which includes a slot 22 and a bridge 23 crossing the slot 22 to form a tunnel 24 thereunder. The straight section 15 of the handle bar 14 passes through the tunnel 24 along the slot 22 to be connected to the base 11. A pin 30 is inserted into a hole on the bridge 23 and through the straight section 15 of the handle bar 14, and then inserted into a hole on a bottom side of the slot 22 to fix the auxiliary stand device 20 to the handle bar 14, referring to the FIG. 4.

Figure 5:
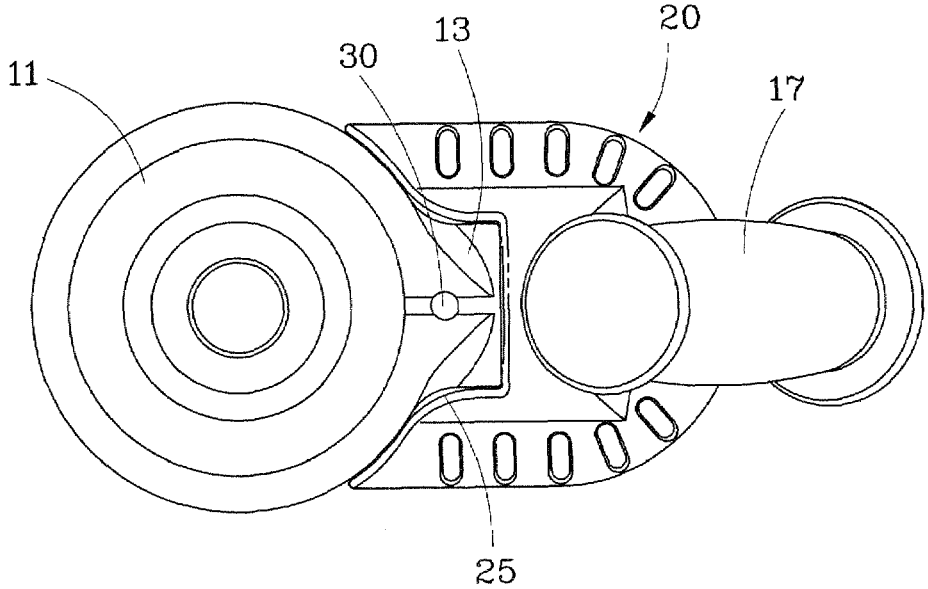
FIG. 5 is a top view of the preferred embodiment of the present invention without the shaft.

As shown in FIG. 5, the auxiliary stand device 20 has an indentation 25 behind the tunnel 24. The indentation 25 is complementary to the protrusion 13 and a portion of the base 11, so that the auxiliary stand device 20 is attached on the base 11 and looks like an extension of the base 11.

Figure 6:
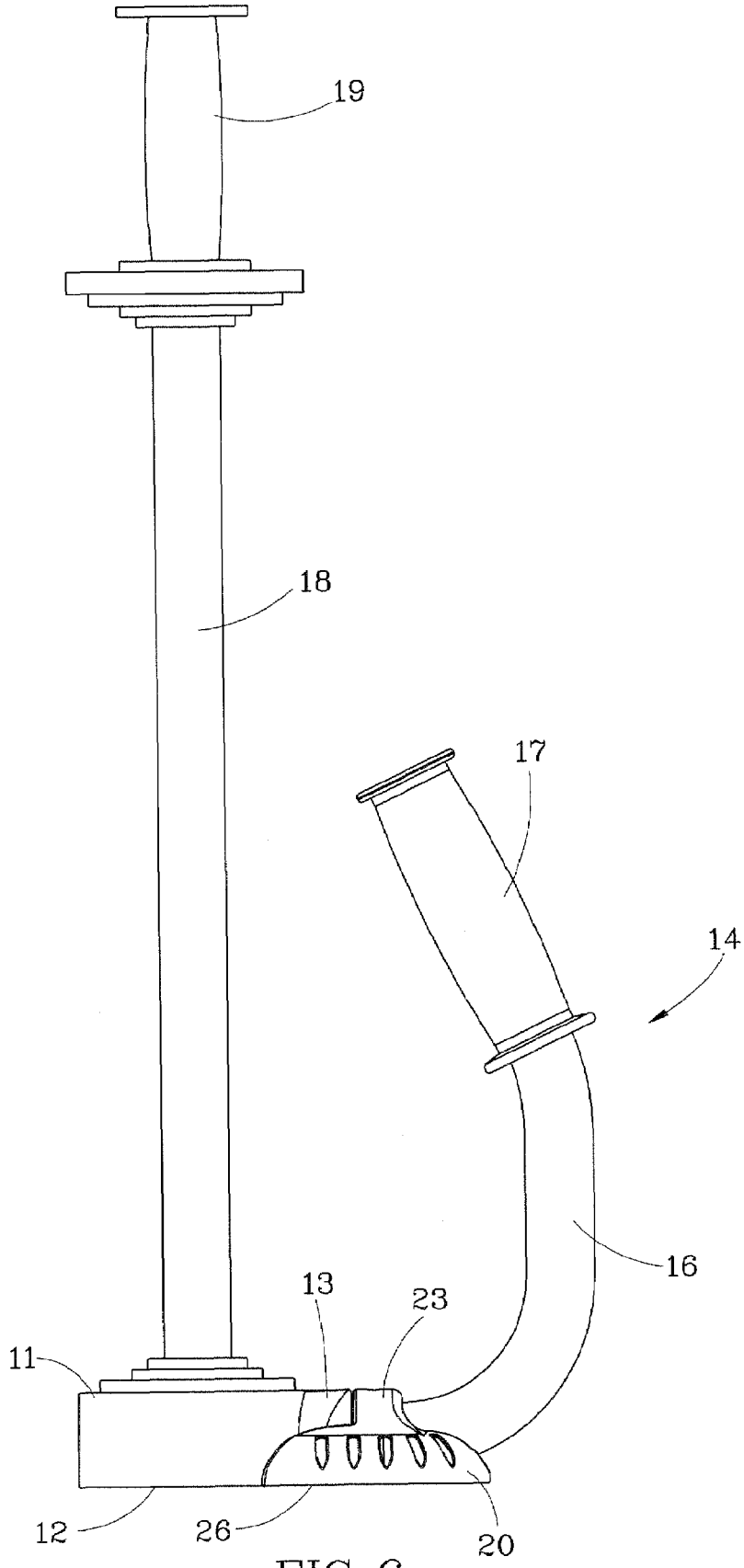
FIG. 6 is a front view of the preferred embodiment of the present invention.

As shown in FIG. 6, a bottom side of the auxiliary stand device 20 is even with the bottom side 12 of the base 11, and a width of the auxiliary stand device 20 is greater than a diameter of the handle bar 14, so that a size of the stretch film dispenser 10 touching the ground is increased from the bottom side 12 of the base to the bottom sides 12 and 26 of the base 11 and the auxiliary stand device 20 that will lower the risk of the tipping over.

The advantages of the present invention are:

1. The auxiliary stand device 20 may be mounted on the conventional stretch film dispenser without having to change its structure.

2. The auxiliary stand device 20, basically, is made of plastic that will not increase the cost much.

3. The stretch film dispenser equipped with the auxiliary stand device 20 of the present invention that will increase the product's competition in the market.

The description above is a few preferred embodiments of the present invention and the equivalence of the present invention is still in the scope of the claim of the present invention.

What is claimed is:

1. A stretch film dispenser, comprising a base, a curved handle bar, which has a handle on a distal end thereof, fixed to a circumference of the base, a shaft, which has a handle on a distal end thereof, fixed to a top of the base to mount a stretch film roll thereon, and an auxiliary stand device having a connecting portion fixed to the handle bar, wherein a bottom side of the auxiliary stand device is substantially even with a bottom side of the base, and a width of the auxiliary stand device is greater than a diameter of the handle bar.

2. The stretch film dispenser as defined in claim 1, wherein the connecting portion of the auxiliary stand device includes a tunnel for the handle bar passing therethrough.

3. The stretch film dispenser as defined in claim 2, wherein the connecting portion of the auxiliary stand device further includes a slot and a bridge crossing the slot to form the tunnel under the bridge.

4. The stretch film dispenser as defined in claim 3, wherein the slot has a section without the bridge crossing over.

5. The stretch film dispenser as defined in claim 3, further including a pin inserted through the bridge and the handle bar.

6. The stretch film dispenser as defined in claim 1, wherein the auxiliary stand device is against the base.

7. The stretch film dispenser as defined in claim 6, wherein the auxiliary stand device has an indentation complementary to the base.

* * * * *